United States Patent [19]

Kaminaka

[11] Patent Number: 4,786,774

[45] Date of Patent: Nov. 22, 1988

[54] COMBINATION COMPACT MICROWAVE OVEN AND VENTILATOR SYSTEM

[75] Inventor: Ikuyasu Kaminaka, Osaka, Japan

[73] Assignee: Sharp Kabushiki Kaisha, Osaka, Japan

[21] Appl. No.: 144,585

[22] Filed: Jan. 6, 1988

Related U.S. Application Data

[63] Continuation of Ser. No. 604,581, Apr. 27, 1984, abandoned.

[51] Int. Cl.[4] ..... H05B 6/64

[52] U.S. Cl. ..... 219/10.55 R; 219/10.55 D

[58] Field of Search ..... 219/10.55 R, 10.55 D, 219/10.55 E, 10.55 F, 10.55 B, 10.55 M; 126/299 R, 299 D, 299 E, 21 R, 21 A, 193, 198; 98/115 R; 312/236

[56] References Cited

U.S. PATENT DOCUMENTS 4,327,274 4/1982 White et al. ..... 219/10.55 R 4,418,261 11/1983 Jailor et al. ..... 219/10.55 R 4,481,396 11/1984 Matsubayashi ..... 219/10.55 B

*Primary Examiner*—Clifford C. Shaw

*Assistant Examiner*—M. M. Lateef

*Attorney, Agent, or Firm*—Flehr, Hohbach, Test, Albritton & Herbert

[57] ABSTRACT

A combination compact microwave oven incorporates ventilator and cooling systems into a unitized structure which may typically be installed on a wall above a conventional electric or gas range. A ventilator assembly including centrifugal fans at the top backward edge is rotatably adjustable for different installations. The space under an outer housing is utilized as an exhaust duct containing a filter means through which exhaust gas can be discharged if there is no external vent available. Air is taken into the cooling system from above through an opening where relatively cool air is expected to be available and is passed through separate air flow channels for efficient cooling of individual areas and components.

9 Claims, 2 Drawing Sheets

COMBINATION COMPACT MICROWAVE OVEN AND VENTILATOR SYSTEM

This is a continuation of application Ser. No. 604,581 filed Apr. 27, 1984, abandoned.

BACKGROUND OF THE INVENTION

This invention relates to a compact, or space-saving type microwave oven which incorporates a ventilator system as well as a cooling system into a unitized structure.

Compact microwave ovens are quickly becoming popular household items. A compact microwave oven is essentially a microwave oven of a conventional type and its hood combined into a unitized structure. It must therefore be installed like the hood of an ordinary range, and this means that compact microwave ovens are very frequently set above an electric or gas range already installed on the floor and are themselves installed by making use of a wall nearby, or by directly attaching to such a wall, although this involves both the danger of overheating the wall behind and the disadvantage of exposing the microwave oven to the heat, smoke, vapor grease-carring air, etc. from the heating device beneath.

It is therefore an object of the present invention to provide a space-saving type microwave oven with a ventilator system incorporated into a unitized structure which is so adapted that a uniform rate of exhaust air flow can be obtained independently of the characteristics of the external vent to which it is connected such as its length and inner diameter, and the direction in which the exhaust air must travel from the ventilator system to that vent.

It is another object of this invention to provide a combination compact microwave oven with ventilator and cooling systems so designed that relatively cool air available in the vicinity be taken in.

It is a further object of this invention to provide a combination compact microwave oven with ventilator and cooling systems so designed that no extra unit is required even if there is no external vent nearby and the exhaust gas from the ventilator system must be discharged back into the room.

It is still another object of the present invention to provide a combination compact microwave oven with ventilator and cooling systems so designed that various heat-producing elements are cooled by cooling air circulated in separate channels.

DETAILED DESCRIPTION OF THE INVENTION

Figure 1:
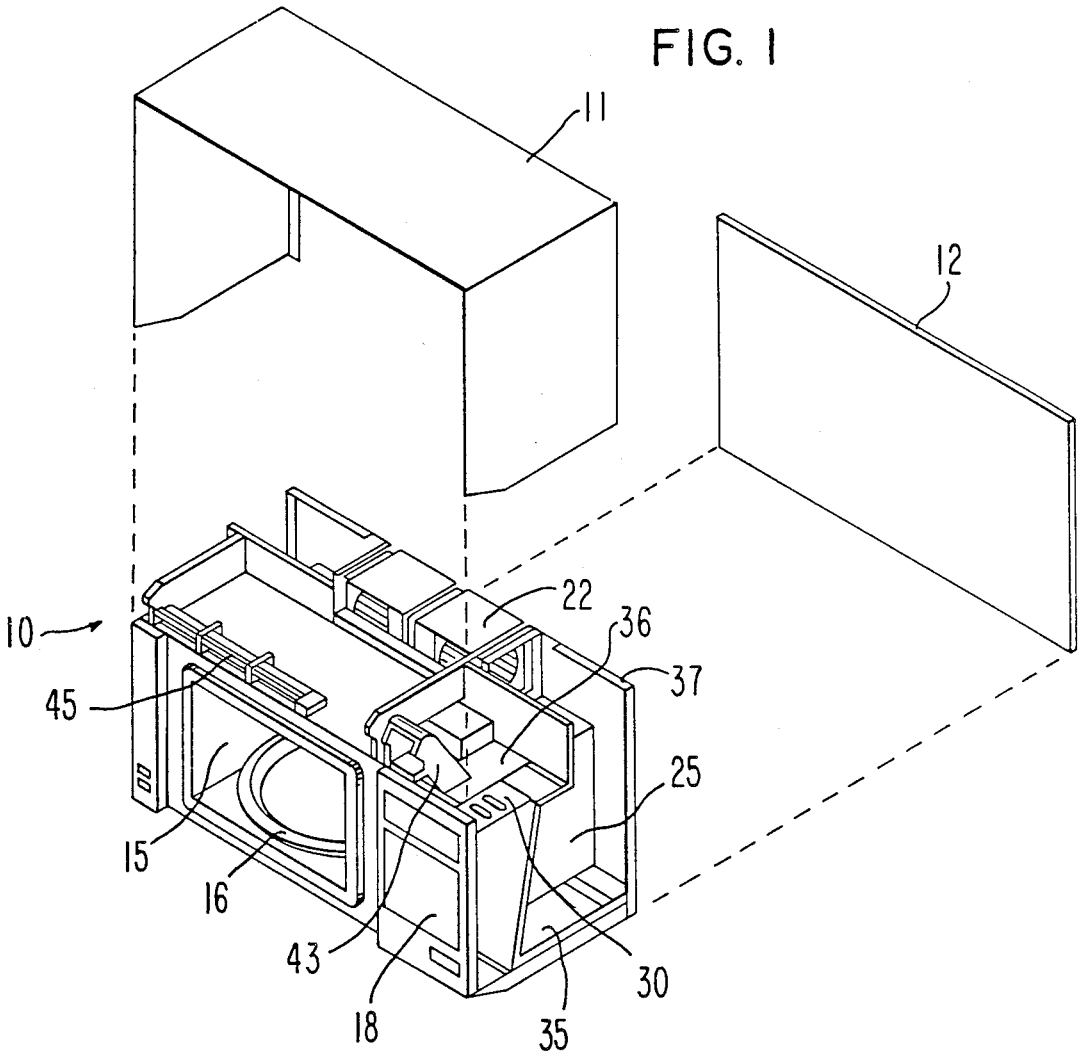
FIG. 1 is a perspective view of a compact microwave oven embodying the present invention with its cabinet and back panel removed to present a partially exploded view.
Figure 2:
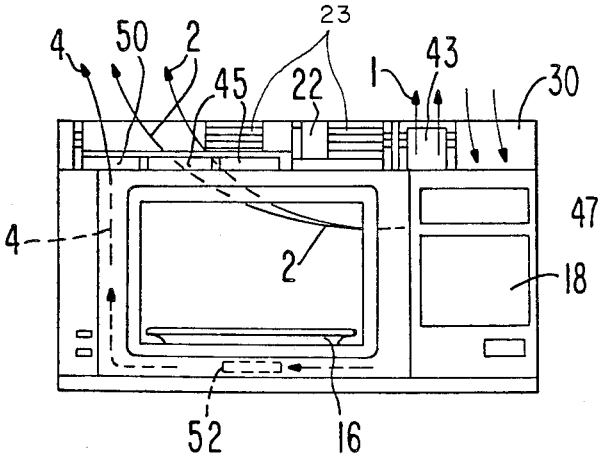
FIGS. 2, 3, 4 and 5 are respectively a front, back, top and bottom view of the oven of FIG. 1.
Figure 3:
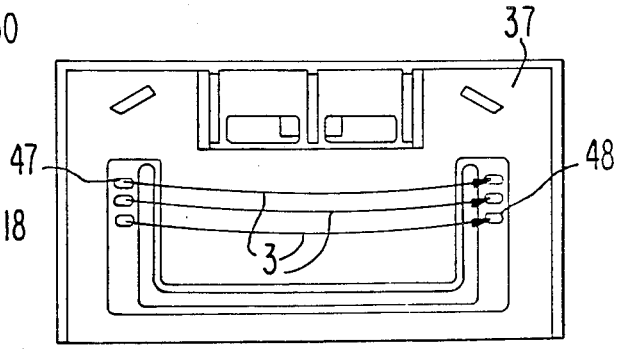
Figure 4:
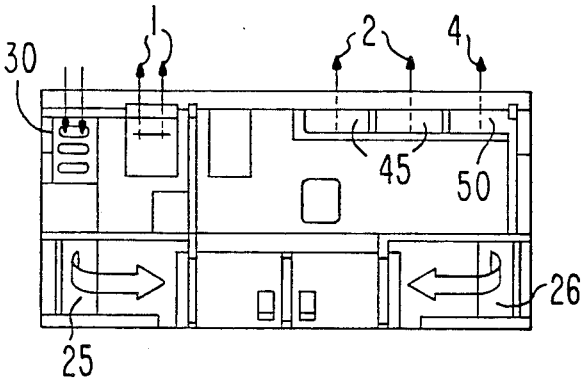
Figure 5:
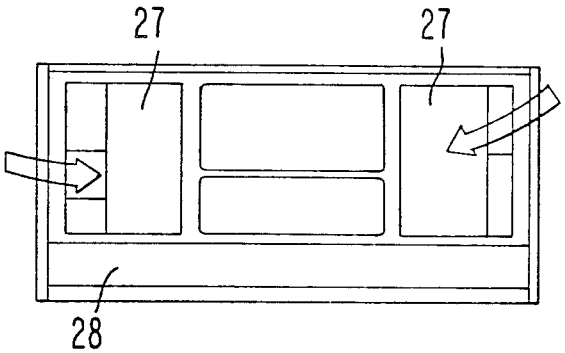
Figure 6:
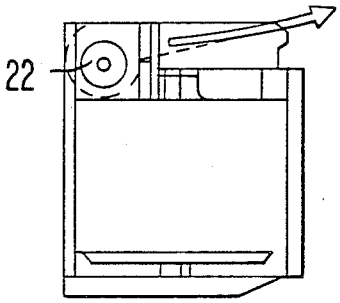
FIGS. 6 and 7 are respectively a left side view of the oven of FIG. 1 with and without the left-hand ventilation duct removed.
Figure 7:
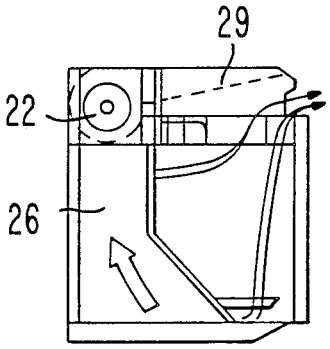
Figure 8:
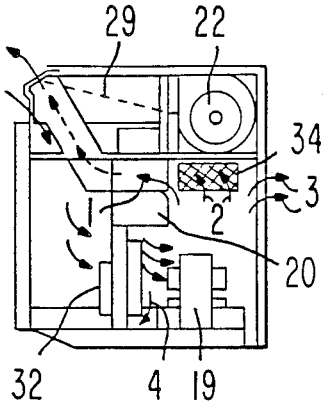
FIGS. 8 and 9 are respectively a right side view of the oven of FIG. 1 with and without the right-hand ventilation duct removed.
Figure 9:
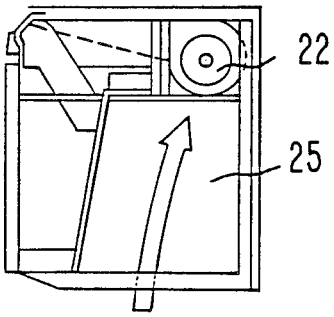

In FIG. 1, there is shown a perspective view of a compact microwave oven 10 according to the present invention with a cabinet, or outer housing 11 and a back attachment panel 12 removed to show its interior arrangements. FIGS. 2–5, 7 and 9 show partially sectional view of the same oven 10 as seen respectively from the front, back, top, bottom, left-hand side and right-hand side. FIGS. 6 and 8 are the left- and right-hand side views with the ventilation ducts removed to show the interior design. Like parts are assigned like numerals while single arrows with numerals 1–4 and thick arrows indicate principal air movements.

Figure 10:
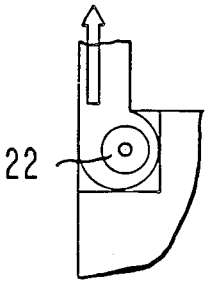
FIGS. 10 and 11 are each a portion of FIG. 10 showing how the ventilator motor can be connected to an external exhaust vent, depending on the position of the vent with respect to the oven.
Figure 11:
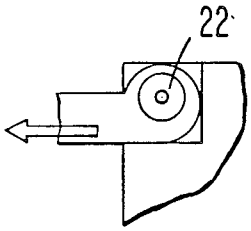

The oven 10 comprises a cooking chamber 15 which by itself is of a conventional type having a rotatably mounted turntable 16 inside, a control panel 18 next to the cooking chamber 15 and facing the front, a high voltage transformer 19 and a magnetron 20. The ventilator system of the oven, or that part of the oven 10 for removing hot, moist and sometimes grease-laden air generated, for example, by cooking on the range below, comprises a ventilator motor 22 and centrifugal fans 23 which are driven by it and installed on either side of it like its left and right wings. The ventilator motor 22 with the centrifugal fans 23 on its sides is positioned at the top, back edge of the oven 10. The ventilator system further comprises a right-hand ventilation duct 25 and a left-hand ventilation duct 26 which are nearly vertical air passages having exhaust gas intake openings 27 in the base panel cover 28 and conducts the exhaust gas from the heating device below to the centrifugal fans 23. The ventilator unit combining the ventilator motor 22 and the centrifugal fans 23 is so designed that its orientation can be rotationally adjustable so that the outlet for exahust gas from the ventilator unit can be connected conveniently with an external exhaust vent available nearby when the oven 10 is installed. FIG. 10 shows a situation where such connection is made to a vent above the oven 10. FIG. 11 shows a situation where such vent is behind the oven 10. If there is no external vent available conveniently nearby, exhaust gas from the ventilator unit must be recycled back into the same room. For such situations, there is provided a charcoal filter 29 placed in the space above the cooking chamber 15 and below the cabinet 11 which space is utilized as exhaust duct.

As for the cooling system of the combination compact oven 10, a cooling air intake 30 is provided behind the top part of the control panel 18 because this is the region where relatively cool air is generally available near the oven 10 under typical working conditions with consideration given to heat generated by the electric or gas range underneath. A propeller fan 32 is so disposed that the cooling air from the intake 30 can be directly blown onto the high voltage transformer 19 because it is usually the component with the highest rate of temperature increase and hence requires highest cooling efficiency. The transformer 19 is disposed inside a compartment 33 formed by a base panel 35, top panel 36, rear panel 37, the magnetron 20, the right-hand side panel of the cooking chamber 15 and the right-hand ventilating duct 25. The propeller fan 32 sends air from the intake 30 into this compartment 33 to increase the pressure inside and causes the air to leave the compartment 33 by branching out into the following four routes provided for cooling purposes. Route 1 is for cooling the magnetron 20 and includes a magnetron air discharge duct 43 through which air in Route 1 leaves the oven 10. Route 2 is for removing from the inside surface of the front door, or window, of the cooking chamber 15 the moisture from the vapor generated therein. The partition wall between the cooking chamber 15 and the compartment 33 is provided with apertures 34 through which cooling air enters the cooking chamber 15. The air then leaves it through a discharge duct 45. Air in Route 3 enters and leaves from the gap between the rear panel 37 and the back attachment panel 12 respectively through right-hand and left-hand back openings 47 and 48, and is discharged through an cooling air discharge duct 50. Air in this route cools the area of contact between the oven 10 and the wall on which it may be attached. Air in Route 4 finally, passes between the floor of the cooking chamber 15 and the base panel 35 to cool the turntable motor 52 and is led outside through the cooling air discharge duct 50.

A compact microwave oven according to this invention has many important advantages. Firstly, since the ventilator unit with a motor and centrifugal fans can be adjustably rotated at the time of installation to change the direction of discharge, the normal increase in pressure loss inside the vent can be reduced and a uniform rate of discharge (ventilation capacity) can be obtained regardless of the manner of installation, or whether the discharge is made vertically as shown in FIG. 10 or horizontally as shown in FIG. 11. Secondly, if there is no external vent available in the room, the exhaust gas from the range below is pushed by the centrifugal fans 23 and is passed through a filter 29 before it is discharged. This obviates the need for the installation of a separate filtering unit. Since the ventilator unit is at an elevated location with respect to the cooking chamber 15, a large portion of the space above the cooking chamber 15 and below the cabinet 11 can be utilized as exhaust duct. This further obviates the need for an extra duct for forcing air to pass through the filter 29, contributing to the reduction in the total size of the oven 15. Thirdly, the cooling system is designed for improved efficiency. The cooling air intake 30 is advantageously located where relatively cool air is available. Fourthly, the cooling effort is concentrated on the transformer 19 which heats up at the fastest rate. Fifthly, cooling air in the compartment 33 is immediately branched into independent routes to cool different areas and components of the oven. This enables a structure with fewer ducts and improves the overall cooling efficiency.

This invention has been described above in terms of only one embodiment, but the description above is to be considered as illustrative rather than as limiting and this invention is accordingly to be broadly construed. For example, the dimensions and shapes of individual components need not be exactly as illustrated, nor are the numbers of apertures at various openings required to be the same as those shown in the drawings. The filter 29 need not be of charcoal type. The scope of this invention is limited only by the following claims.

I claim:

1. A compact microwave oven incorporating ventilator and cooling systems into a unitized structure, comprising a housing containing therein a cooking chamber and a compartment having a high voltage transformer disposed therein, a cooling air intake means for introducing cooling air from outside through an intake opening directly into said compartment, said intake opening being provided to said housing at an elevated frontal position thereof, a plurality of substantially independent air passages establishing separate airflow routes out of said compartment, a cooling system fan adapted to cause cooling air to enter said compartment through said air intake means and to leave said compartment through said air passages, said cooling system fan forming a portion of the boundary of said compartment and being disposed proximately in front of said high voltage transformer whereby said transformer is directly exposed to incoming cooling air, and a ventilator assembly with a ventilator motor and centrifugal fans sandwichingly attached to both sides of said ventilator motor, said ventilator assembly being rotatably mounted at an elevated and backward part in said housing such that exhaust gas can be directed in an upward or backward direction by adjustingly rotating said ventilator assembly.

2. The compact microwave oven of claim 1 further comprising a magnetron, said plurality of air passages including a first cooling air passage which is so adapted that cooling air flowing in said first air passage tends to remove heat from said magnetron directly.

3. The compact microwave oven of claim 1 wherein said plurality of air passges include a second cooling air passage which includes a means for allowing air to flow from said compartment to said cooking chamber.

4. The compact microwave oven of claim 3 wherein said cooking chamber is adjacent to said compartment and comprises an apertured partition wall therebetween.

5. The compact microwave oven of claim 3 further comprising an attachment panel at the back of said oven for the convenience of installation thereof on a vertical wall, said plurality of air passages including a third cooling air passage, said attachment panel forming a portion of the boundary of said third cooling air passage.

6. The compact microwave oven of claim 4 further comprising a turntable which is rotatably mounted in said cooking chamber and a turntable motor, said plurality of air passages further including a fourth cooling air passage adapted to remove heat from said turntable motor by air flow therethrough.

7. The compact microwave oven of claim 1 further comprising one or more ventilation ducts for allowing air from below said oven to said centrifugal fan assembly.

8. The compact microwave oven of claim 7 including an auxiliary exhaust duct formed between said housing and said cooking chamber, above said cooking chamber and leading to the front of said housing, said ventilator assembly being optionally so adjustable as to discharge air from said assembly through said auxiliary exhaust duct.

9. The compact microwave oven of claim 8 further comprising a filter means in said auxiliary duct.

* * * * *